US006473515B2

(12) United States Patent
Wong

(10) Patent No.: US 6,473,515 B2
(45) **Date of Patent: *Oct. 29, 2002**

(54) CAP AND CENTER POLE APPARATUS AND METHOD OF COUPLING

(76) Inventor: Ching Tong Wong, Tucheng Industrial Park, No. 50-52, Chan Shan Road, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/805,096

(22) Filed: Mar. 13, 2001

(65) Prior Publication Data

US 2001/0017929 A1 Aug. 30, 2001

Related U.S. Application Data

(63) Continuation of application No. 09/277,639, filed on Mar. 26, 1999, which is a continuation-in-part of application No. 08/908,564, filed on Aug. 8, 1997, now abandoned.

(51) Int. Cl.[7] ..... H04R 25/00

(52) U.S. Cl. ..... 381/405; 381/419; 381/422; 29/594

(58) Field of Search ..... 381/397, 396, 381/405, 412, 419, 420, 422, FOR 161; 29/594

(56) References Cited

U.S. PATENT DOCUMENTS

| | | | |
|---|---|---|---|
| 2,231,479 | A | 2/1941 | Perry |
| 2,367,026 | A | 1/1945 | Hutter |
| 3,250,862 | A | 5/1966 | Rollins |
| 3,293,378 | A | 12/1966 | Heppner |
| 3,459,320 | A | 8/1969 | Itoh |
| 3,578,104 | A | 5/1971 | Sotome |
| 3,830,986 | A | 8/1974 | Yamamuro |
| 3,851,118 | A | 11/1974 | Kleis et al. |
| 3,862,376 | A | 1/1975 | White |
| 3,867,587 | A | 2/1975 | Yamamuro |
| 3,922,501 | A | 11/1975 | Yamamuro |
| 4,225,756 | A | 9/1980 | Babb |
| 4,225,757 | A | 9/1980 | Babb |
| 4,281,223 | A | 7/1981 | Ugaji et al. |
| 4,289,937 | A | 9/1981 | Ikeda et al. |

(List continued on next page.)

FOREIGN PATENT DOCUMENTS

| | | |
|---|---|---|
| EP | 624048 A1 | 11/1994 |
| FR | 1.424.257 | 11/1965 |
| GB | 819758 | 9/1959 |

OTHER PUBLICATIONS

PCT International Search Report for International Application No. PCT/IB98/01550 Mar. 4, 1999.

PCT International Search Report for International Application No. PCT/IB00/00347 Oct. 5, 2000.

*Primary Examiner*—Curtis Kuntz
*Assistant Examiner*—Suhan Ni
(74) *Attorney, Agent, or Firm*—Hahn Loeser & Parks, LLP; Robert J. Clark

(57) ABSTRACT

The present invention comprises an improved center pole having a distortion reduction cap and an improved method of coupling the cap to a speaker center pole. The speaker assembly comprises a distortion reduction cap and a cylindrical center pole having a gripping surface formed on an outer cylindrical surface of the center pole and a frustoconical recess on a top surface of the center pole. The cap is coupled to the center pole through the application of pressure on the cap to conform the cap to the center pole and to non-rotatably couple the cap onto the center pole by deforming a portion of the cap against the gripping surface. The distortion reduction cap is coupled to the center pole in a manner forming a corresponding frustoconical portion mating with the frustoconical recess on the top surface of the center pole in a manner providing an air tight seal.

10 Claims, 6 Drawing Sheets

U.S. PATENT DOCUMENTS 4,354,609 A 10/1982 Hidding
4,387,275 A 6/1983 Shimada et al.
4,387,818 A 6/1983 Conti
4,576,296 A 3/1986 Lecinski
4,580,015 A 4/1986 O'Neill
4,591,672 A 5/1986 Kato et al.
4,661,973 A 4/1987 Takahashi
4,825,533 A 5/1989 Hayashi et al.
4,860,370 A 8/1989 Grosbard
4,914,707 A 4/1990 Kato et al.
4,914,750 A 4/1990 Lawson
5,027,412 A 6/1991 Hayashi et al.
5,048,533 A 9/1991 Muz
5,117,462 A 5/1992 Bie
5,151,943 A 9/1992 Van Gelder
5,402,503 A 3/1995 Prokisch
5,408,533 A 4/1995 Reiffin
5,546,470 A 8/1996 Geisenberger et al.
5,640,461 A 6/1997 Ebert et al.
5,811,684 A 9/1998 Sokn
5,853,097 A 12/1998 Ekkert
5,927,531 A 7/1999 Kuzma et al.
5,940,522 A 8/1999 Cahill et al.
5,996,419 A 12/1999 Sokn

CAP AND CENTER POLE APPARATUS AND METHOD OF COUPLING

TECHNICAL FIELD

This application is a continuation of copending application Ser. No. 09/277,639 filed on Mar. 26, 1999 which is a continuation-in-part of application Ser. No. 08/908,564 filed on Aug. 8, 1997, now abandoned. Copending application Ser. No. 09/277,639 and application Ser. No. 08/908,564 are hereby incorporated by reference. The present invention relates to improved audio speaker acoustics and more specifically to the elimination of distortion from a speaker through the use of an improved distortion reduction cap and center pole configuration and method of coupling the two.

BACKGROUND OF THE INVENTION

Normal magnetic material has a magnetic hysteresis loop characteristic and the relation of magnetizing force and magnetic flux density is nonlinear. As a result, when magnetic flux of a voice coil passes through a center pole and a plate near an air gap, the magnetic reaction in the voice coil results in a distorted output signal from the speaker.

A conventional speaker of the type contemplated by the present invention is illustrated in FIG. 1. The unit shown in FIG. 1 has a pole yolk 12 with an inverted T-cross section which has around its bottom an annular magnet 14 that is magnetized in the direction of its thickness. A top plate 18 rests on magnet 14 to form a magnetic gap with the peripheral wall of center pole 16 of pole yolk 12. A voice coil 28 wound around a bobbin 30 is inserted into the magnetic gap. Bobbin 30 is supported on a frame 26 by a damper 24 that permits vibratory movement of bobbin 30. A diaphragm 22 with a dust cover 20 is connected to bobbin 30. The outer periphery of diaphragm 22 is supported by an edge portion 32 that is fixed to frame 26 by a gasket 34. In order to make effective use of the magnetic flux in the gap, voice coil 28 is wound around bobbin 30 a length in the longitudinal direction of the coil which is greater than the magnetic gap link. Center pole 16 of pole yolk 12 is fitted with a cap 36 provided to reduce the distortion that is introduced into the coil current by the inductance of voice coil 28. The operation of the speaker shown in FIG. 1 is as follows. When a current flows through voice coil 28, either an upward or downward driving force acts on coil 28 depending upon the direction of the current flow. Since voice coil 28 is mobile, the driving force acting on voice coil 28 is transmitted to diaphragm 22 through bobbin 30. As a result, diaphragm 22 pushes the air in front of it, creating sound waves.

Various methods of eliminating the distortion described above have been attempted, such as covering a center pole with a copper cap as described in FIG. 1, and putting a copper ring around the center pole. The copper ring requires a higher level of manufacturing technique and tends to disturb the magnetic flux distribution in the speaker's air gap thus interfering with the output signal. The application of a copper cap covering the center pole of a speaker has been more successful but also has several drawbacks.

The pole/cap configuration and processes used in the prior art for coupling the cap have not resulted in an easily manufactured assembly which performs well, particularly in high volume production environments. FIG. 2 is directed to one prior art method for coupling the cap described briefly in FIG. 1, to a speaker center pole to reduce the distortion introduced into the speakers voice coil due to inductance are shown. FIGS. 2*a* and 2*b* demonstrate different methods of coupling a distortion reduction cap to center pole 16 of pole yolk 12. In both methods the cap must be formed on cap die press 40. FIG. 2*a* shows the prior art method of coupling distortion reduction cap 46 with adhesives at 42. Once cap 46 is formed by cap die press 40, applicator 48 applies an adhesive, such as glue, within cap 46 which in turn is coupled onto center pole 16 of pole yolk 12 to form partial speaker assembly 50. Use of an adhesive requires additional manufacturing steps to provide the correct amount of adhesive to ensure that center pole 16 receives an even coating to securely couple cap 46. Distortion reduction cap 46 must also be properly coupled to center pole 16 to ensure no air gaps are formed between cap 46 and center pole 16. Such gaps reduce the effectiveness of cap 46.

In order for distortion reduction cap 46 to provide maximum reduction in distortion there must not only be no air gaps between cap 46 and center pole 16 but cap 46 must also remain absolutely stationary. Adhesives used in the prior art are problematic because when subjected to varying temperatures and environmental conditions they can loosen and allow cap 46 to vibrate and move again creating air gaps which effect the distortion reduction performance of cap 46. FIG. 2*b*, at 44, shows an alternate method found in the prior art for coupling a distortion reduction cap to a speaker center pole. The process begins with cap 52 being formed on cap die press 40. Distortion reduction cap 52 is shown in cross-section and is identical to cap 46 with the exception of an annular inwardly extending lip 54. Instead of using an adhesive to maintain the coupling between cap 52 and center pole 16 of yolk 12, the coupling is instead maintained by forcing the lower portion of cap 52 into axial inwardly formed groove 56 within center pole 16. The portion of cap 52 forced within groove 56 becomes annular inwardly extending lip 54. This method is inadequate as it does not prevent cap 52 from rotating upon center pole 16 once retained in place, and may result in air gaps between cap 52 and center pole 16. Vibration from sound waves and due to imperfect road conditions, if the speakers are used in automobiles, may cause such rotation which allows air gaps between cap 52 and center pole 16 to again reduce the effectiveness of distortion reduction cap 52.

Although not previously discussed, larger conventional type speakers of the type contemplated by the present invention use a center pole which includes a through hole through the center axis of the center pole. Another method for reducing distortion is to keep dust and debris from entering this chamber and affecting the diaphragm. A dust screen is typically attached to the pole yolk with an adhesive. Adhesives used in the prior art are problematic because when subjected to varying temperatures and environmental conditions they can loosen providing gaps around the edges of the screen or disengaging the screen altogether which will allow dust and other contaminants into the speaker affecting the diaphragm and resulting in increased distortion.

Therefore, in light of the foregoing deficiencies in the prior art, the applicant's invention is herein presented.

SUMMARY OF THE INVENTION

The present invention comprises an improved center pole speaker assembly having a distortion reduction cap and an improved method of coupling the cap to a speaker center pole. These and other advantages are provided by a speaker assembly comprising a distortion reduction cap and a cylindrical center pole having a gripping surface formed on an outer cylindrical surface of the center pole and a frustoconical recess on a top surface of the center pole. The distortion reduction cap is coupled to the center pole through the application of pressure on the cap to conform the cap to the center pole and to non-rotatably couple the cap onto the center pole by deforming a portion of the cap against the gripping surface. The distortion reduction cap is coupled to the center pole in a manner forming a corresponding frustoconical portion mating with the frustoconical recess on the top surface of the center pole.

The present invention also provides a method of coupling a distortion reduction cap to a speaker center pole to reduce audio distortion comprising the following steps. Forming a distortion reduction cap. Forming a gripping surface on a center pole having a frustoconical recess on a top surface of the center pole wherein the gripping surface extends radially outwardly from the center pole. Positioning the distortion reduction cap over the center pole. Applying pressure on the distortion reduction cap to conform the distortion reduction cap to the center pole and non-rotatably couple the distortion reduction cap onto the center pole by deforming a portion of the distortion reduction cap against the gripping surface and deforming a portion of the distortion reduction cap forming a corresponding frustoconical portion of the distortion reduction cap mating with the frustoconical recess on the top surface of the column.

These along with other advantages of the present invention will become more readily apparent from a reading of the detailed description taken in conjunction with the drawings and the claims.

DETAILED DESCRIPTION OF THE PREFERRED EMBODIMENT

Figure 1:
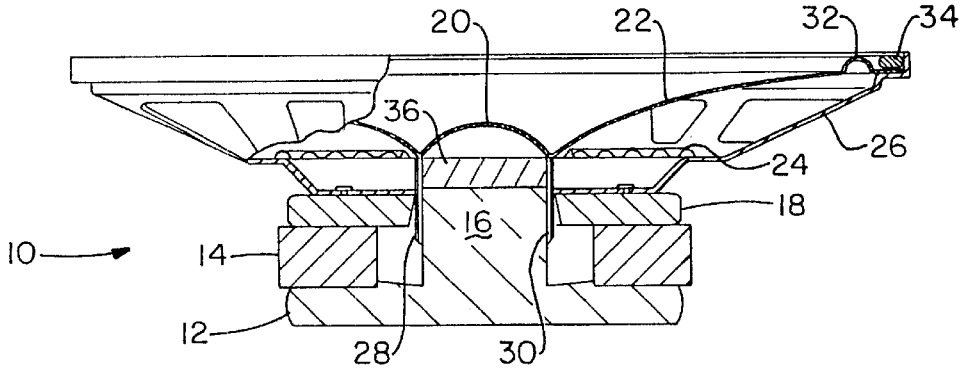
FIG.-1 Prior Art
FIG. 1 is a elevational view in partial cross section of a typical acoustic speaker.
Figure 2:
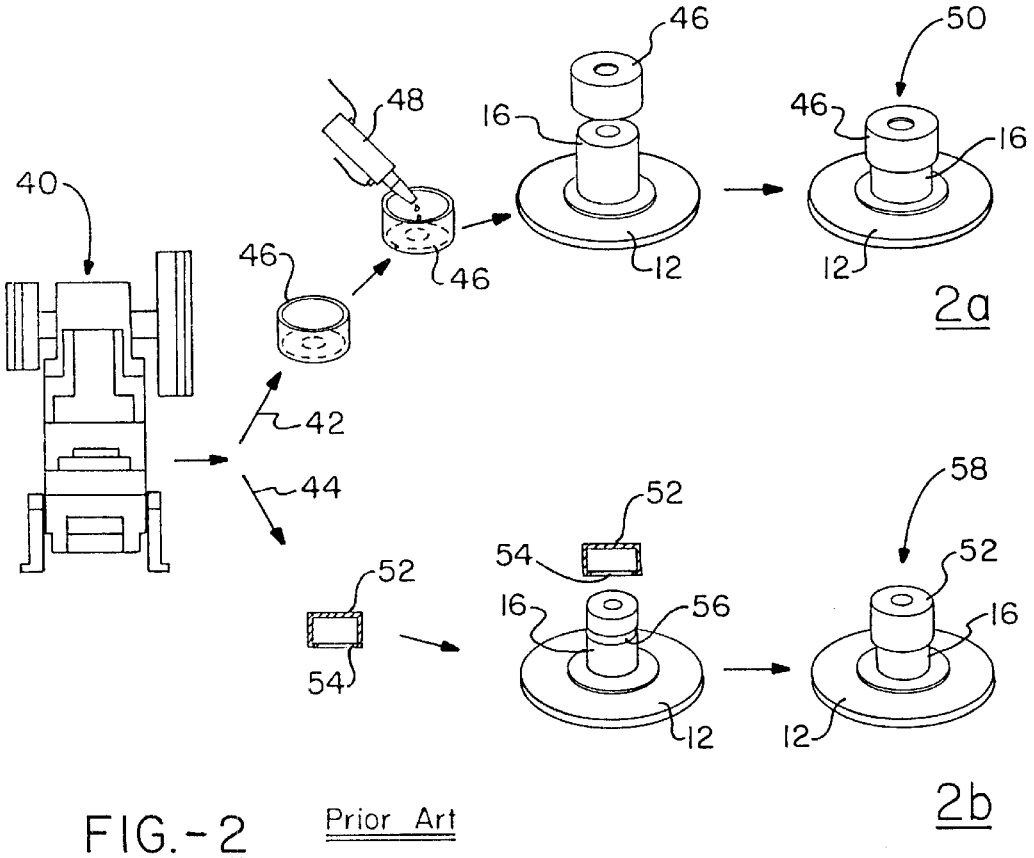
FIG.-2 Prior Art
FIG. 2 illustrates the steps required in two prior art methods of coupling a cap with a speaker center pole.
Figure 3:
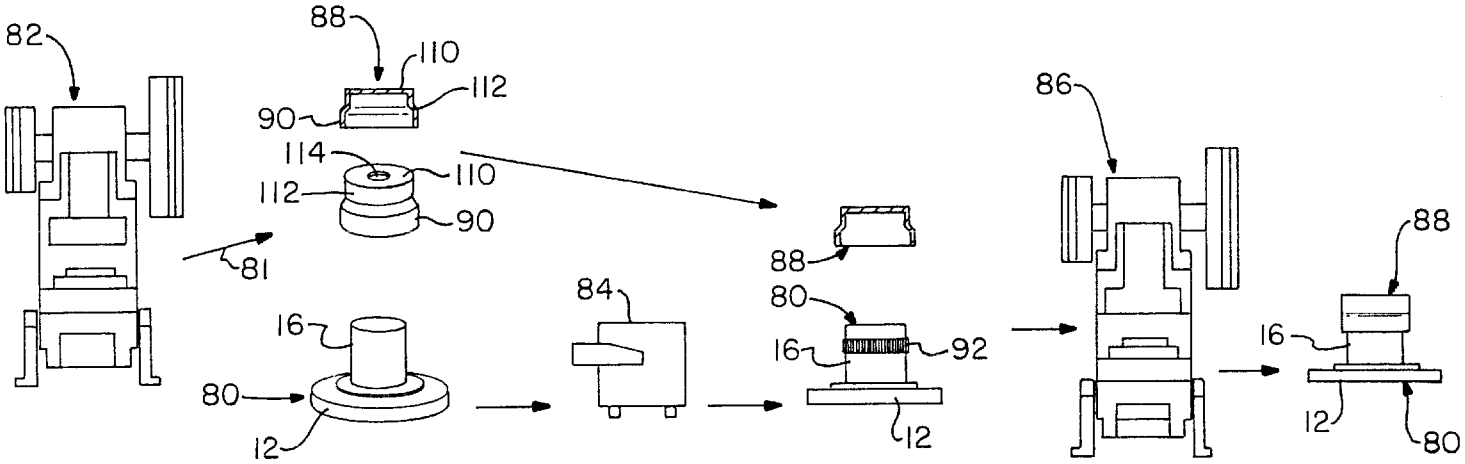
FIG. 3 illustrates the steps required in one of the preferred embodiments of the present invention for coupling a distortion reduction cap to a speaker center pole.
Figure 3B:
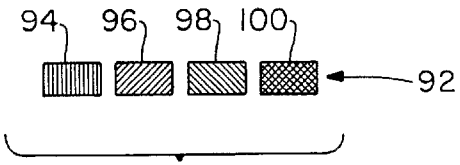
FIG. 3B illustrates various gripping surface configurations which may be applied to the center pole to secure a cap thereon.
Figure 3A:
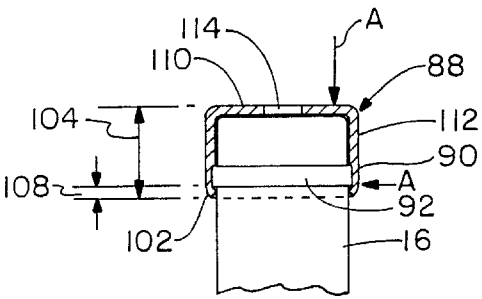
FIG. 3A is a partial elevational view also in partial cross-section showing a pole/cap relationship which may be accomplished via the steps illustrated in FIG. 3.

FIGS. 3, 3A and 3B show the preferred embodiment of the present invention which consists of both improved distortion reduction cap 88 and the method of applying cap 88. The process of manufacturing the pole/cap assembly of the invention in a first step forms distortion reduction cap 88 in cap die press 82. Cap 88 is shown in both perspective and cross-section after exiting cap die press 82 at 81. In the preferred embodiment, cap 88 is comprised of planar surface 110, preferably circular in shape, having side wall 112 coupled to the periphery of planar surface 110 and extending from and perpendicular to planar surface 110.

Side wall 112 includes an axial flare or enlarged diameter portion 90 formed along or near the lower edge of side wall 112 opposite planar surface 110 and is essentially formed at a diagonal angle. If axial flare 90 is formed near the lower edge of side wall 112 as opposed to along the lower edge, side wall 112 will have two different inner diameters separated by axial flare 90 where the portion of side wall 112 furthest from planar surface 110 will be larger than the diameter for the portion of side wall 112 closest to planar surface 110. Planar surface 110 may also include aperture 114 disposed through its center to provide improved sound and manufacturing characteristics. Axial flare 90 will eventually mate with an axial or outwardly extending grip pattern 92 which is formed on center pole 16 of pole yolk 12 by pattern roller 84.

The combination of center pole 16 and pole yolk 12 will also be referred to as center pole assembly 80. Center pole assembly 80 is made up of a circular planar surface having a column extending outward which forms center pole 16. Formed on and around center pole 16 is an axial griping surface 92 which may comprise an outwardly extending surface having one of several different patterns such as vertically oriented score lines or splines 94, diagonal lines score 96 and 98, or a cross-hatch pattern of score lines 100, any of which may be formed on center pole 16 by a pattern roller 84 as these are illustrated in FIG. 3B. In the preferred embodiment either diagonal pattern 96 or 98 is used to provide the most effective gripping action to maintain cap 88 on center pole 16 by interference fit. Cross-hatch pattern 100 is also very effective but increases the amount of metal shavings which must be removed from center pole assembly 80 which would otherwise interfere with the intended reduction of distortion. The axial gripping surface 92 may be slightly raised from the side wall surface of center pole 16 in which cap 88 is eventually coupled. During coupling, axial flare 90 is stretched over raised axial gripping surface 92 forming stretched latching portion 102 as shown in FIG. 3A.

After cap 88 is formed and center pole assembly 80 has received axial gripping surface 92, cap 88 is placed on center pole 16 of center pole assembly 80 and inserted within cap applicator press 86. The end result after operation of cap applicator press 86 is shown in more detail in FIG. 3A where cap 88 is coupled to center pole 16 with axial flare 90 stretched against and over axial gripping surface 92 with stretched latching portions 102 formed against center pole 16 to effectively grip the axial gripping surface 92. The portion of cap 88 which is pressed against axial gripping surface 92 is forced to conform to the pattern so that the material cap 88 is fabricated from grips pattern 92. FIG. 3A shows center pole 16 and cap 88 having axial flare 90 wherein the arrows "A" show the forces applied to cap 88 and axial flare 90 by cap applicator press 86 when being mounted to center pole 16. Stretched latching portions 102 of cap 88 provide additional gripping of cap 88 to axial gripping surface 92 but also eliminates gaps which would otherwise be caused if axial flare 90 had simply been stretched downward vertically without being pressed horizontally against center pole 16. Again, any such air gaps reduce the effectiveness of the distortion reduction properties of cap 88.

While the dimensions and materials used for cap 88 and center pole assembly 80 can vary depending on the size of the speaker which assembly 80 is to be used in and/or the specific electromagnetic effect desired, several dimensions and materials will now be described to ensure that one of ordinary skill in the art can practice the preferred embodiment of the invention as disclosed. In the preferred embodiment center pole assembly 80 is comprised of 1008 low carbon steel plated with zinc dichromate. Cap 88 is formed from copper sheets having a uniform thickness of approximately 0.03mm. As shown in FIG. 3A the typical height 104 of cap 88 is approximately 10 mm with stretched latching portion 102 exceeding the width of axial gripping surface 92 at 108 by approximately 1–2 mm. The width of axial gripping surface 92 is approximately 2–4 mm. Axial gripping surface 92 is typically raised from the sidewall of center pole 16 by approximately 0.1–0.2 mm. To further reduce air gaps between cap 88 and center pole 16, the outer diameter of center pole 16 is sized to be extremely close to the inner diameter of cap 88 to provide a secure and tight fit which becomes permanent once axial flare 90 has been stretched over and pressed against axial gripping surface 92. Various high frequency response characteristics are obtainable by changing the intrinsic resistance and thickness of distortion reduction cap 88 and therefore cap 88 can be fabricated from a number of materials including but not limited to copper, anoxic copper, gold, silver, aluminum and various composites formed from these and other materials.

Figure 4:
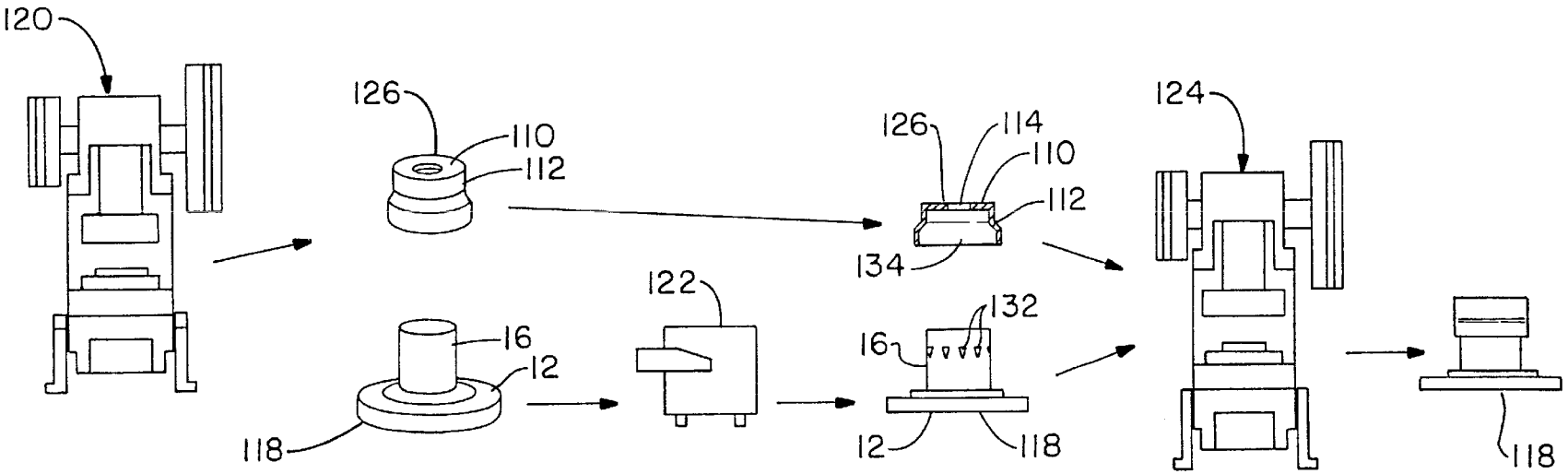
FIG. 4 illustrates the steps required in a second preferred embodiment of the present invention for coupling a distortion reduction cap to a speaker center pole.
Figure 4A:
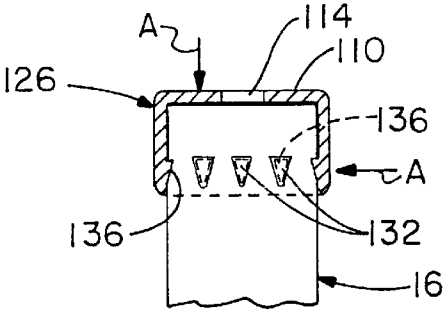
FIG. 4A is a partial elevational view also in partial cross-section showing a pole/cap relationship which may be accomplished via the steps illustrated in FIG. 4.

Referring to FIGS. 4 and 4A, an alternate embodiment of the center pole assembly having a cap mounted thereto is shown with the process for coupling the cap to the center pole assembly. In an identical manner to that described in FIG. 3, cap 126 is formed on cap die press 120 and shown having an axial flare 134. Cap 126 is once again placed on center pole 16 of pole yolk 12 wherein center pole 16 and pole yolk 12 are also referred to as center pole assembly 118. The difference between the center pole assembly shown in FIG. 3 and center pole assembly 118 is that punch hole roller 122 places several indentations or scores 132 in an axial fashion about circumference of center pole 16. FIG. 4A shows that in the preferred embodiment indentations 132 are triangular in shape and face downward, although many other shapes would be suitable. The profile of triangular indentations 132 shown at 138 demonstrates that indentations 132 form a ridge near the top of center pole 16 which then flares diagonally towards the surface of center pole 16 near the downwardly directed point of each triangular indentation 132. Once cap 126 is placed onto center pole assembly 118, the combination is then inserted within cap applicator press 124 which permanently couples cap 126 onto center pole assembly 118. Arrows "A" show the direction of the forces applied to cap 126 and axial flare 134 which stretch axial flare 134 both downward vertically and inward horizontally such that stretched latching portions 136 cover and are forced to conform within triangular indentations 132 as shown, which prevent vertical upward and horizontal side movement of cap 26.

Figure 5:
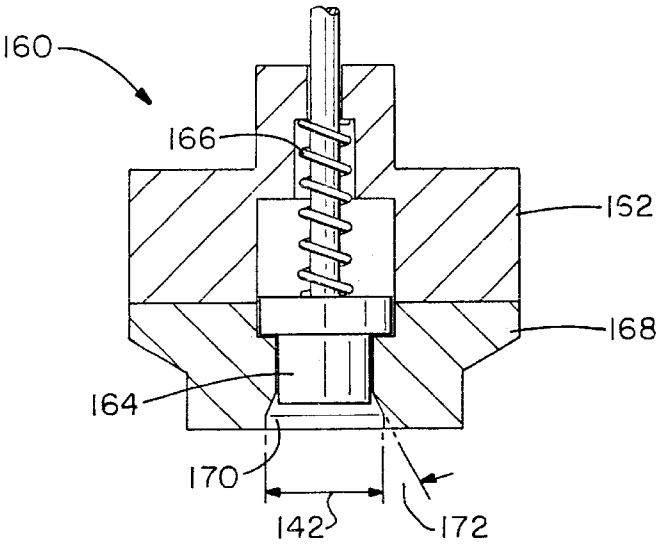
FIG. 5 is an elevational view in partial cross-section illustrating a distortion reduction cap applicator tool which may be applied to coupling a distortion cap to a speaker center pole.
Figure 5A:
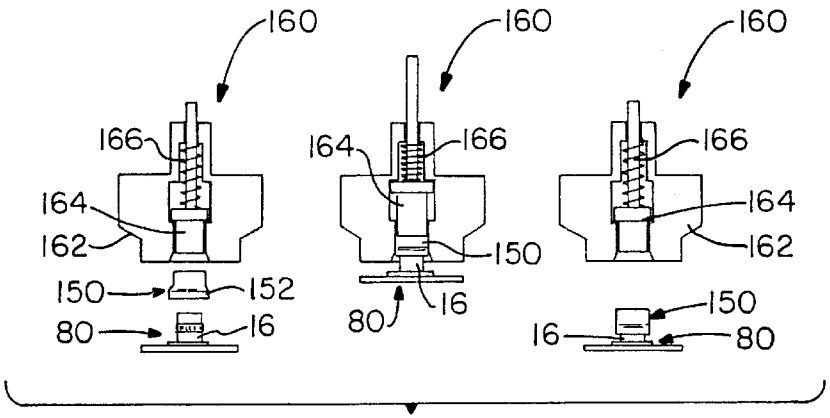
FIG. 5A diagrammatically illustrates the steps of pole/cap coupling using the tool shown in FIG. 5.

Referring to FIGS. 5 and 5A, the actual coupling of the cap to the center pole of the center pole assembly will be described in more detail. In order to properly stretch axial flare 152 of cap 150 over axial gripping surface 92 or over and within indentations 132, shown in FIGS. 3A and 4A the cap applicator press must be equipped with cap applicator tool 160. As illustrated in FIG. 5, tool 160 is comprised of housing 162 having an ejection piston 164 disposed through spring 166 and the top of housing 162 to provide a means for ejecting center pole assembly 80 once cap 150 is coupled to center pole 16. Coupled to the bottom of applicator housing 162 is mold 168 having aperture 170 disposed through its center for receiving center pole 16 and cap 150. Once cap 150 is positioned upon center pole 16 having axial gripping surface 92 or indentations 132, center pole assembly 80 or 118 is then positioned beneath cap applicator tool 160 and aligned with aperture 170. While not shown, a press or similar device then pushes center pole assembly 80 thereby forcing center pole 16 and cap 150 within aperture 170. It is also contemplated that center pole assembly 80 is kept stationary while tool 160 is forced down upon cap 150 and center pole 16 to provide the effect. As cap 150 and center pole 16 travel within aperture 170, spring loaded ejection piston 164 is forced upward causing compression of spring 166. Once the pressure applied to force center pole assembly 80 into aperture 170 of cap applicator tool 160 is removed, the force being placed on ejection piston 164 by spring 166 causes ejection piston 164 to move downward to eject center pole assembly 80 from aperture 70. The steps of pole/cap coupling are diagrammatically illustrated in FIG. 5A, using the tool of FIG. 5.

FIG. 5 shows in cross-section the aperture in which cap 150 and center pole 16 are inserted within to seal and stretch cap 150 onto center pole 16 of assembly 80 or 118 respectively. Initially, aperture 170 has a diameter 142 which is larger than the outer diameter of cap 150. As aperture 170 continues within mold 168, a conical section is provided wherein the diameter begins to narrow, which in the preferred embodiment is at an angle of between 15° and 20° in relation to diameter 140. After the conical portion, aperture 170 becomes constant having a diameter small enough to cause cap 150 to be stretched over and pressed against center pole 16 of center pole assembly 80. By having the initial diameter 142 of aperture 170 greater than the outer diameter of cap 150 the initial alignment of center pole 16 and cap applicator tool 160 can be less accurate because axial angle 172 provides a mechanism for correcting the alignment and centering of cap 150 just prior to cap 150 and center pole 16 being driven within smaller diameter 140 to complete the coupling of cap 50 and center pole 16.

Figure 6:
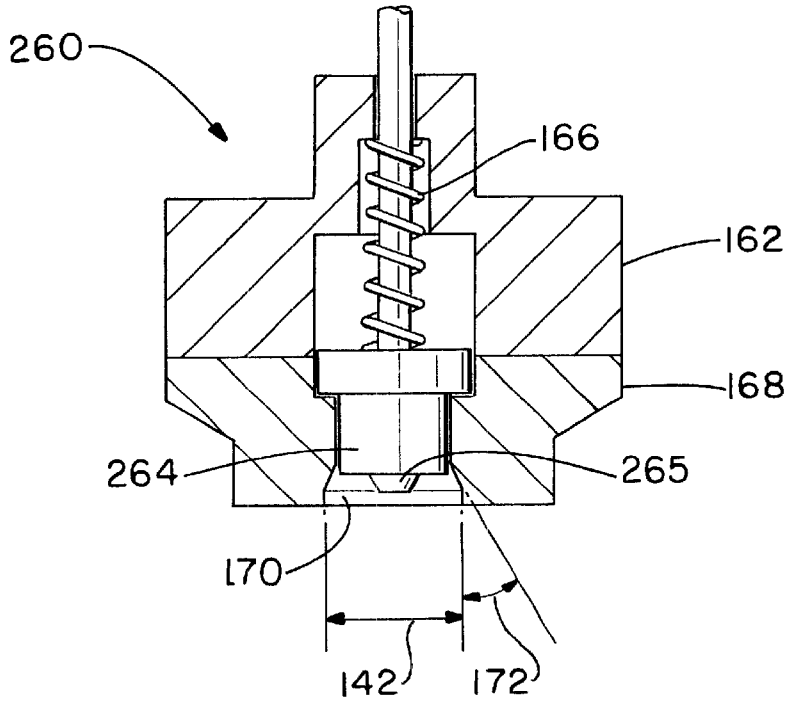
FIG. 6 is an elevational view in partial cross-section illustrating a distortion reduction cap applicator tool with frustoconical extension which may be applied to coupling a distortion cap to a speaker center pole.
Figure 6A:
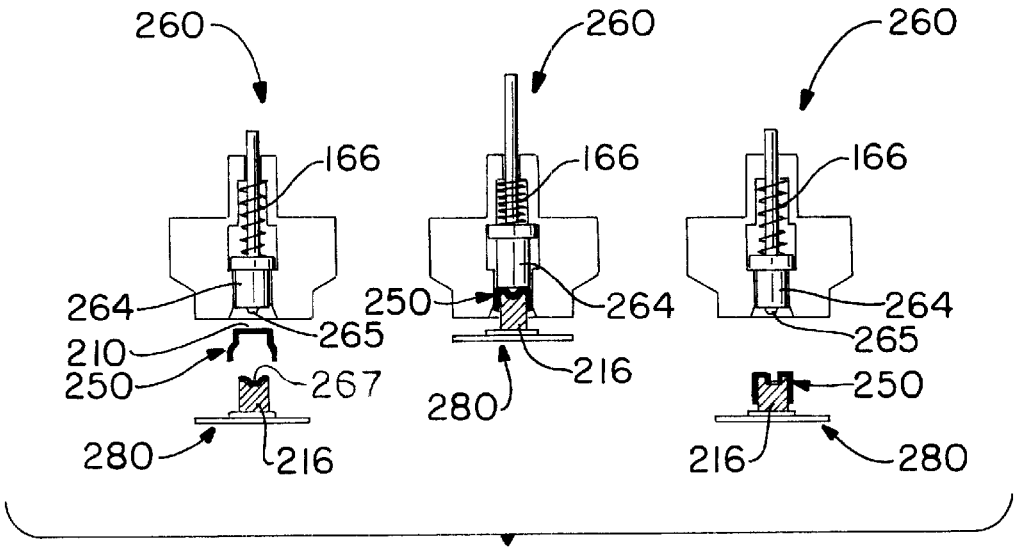
FIG. 6A diagrammatically illustrates the steps of pole/cap coupling using the tool shown in FIG. 6.

Referring to FIGS. 6 and 6A, an alternate preferred embodiment of the invention is shown. The coupling of the cap 250 is the same as in the previous embodiment except that the cap applicator tool 260 has a modified ejector piston 264 that has a frustoconical portion 265 extending downward from the center of the mating surface of the ejection piston 264. The cap 250 is the same as the cap 150 of the previous embodiment but will be attached differently as follows. The coupling of the cap 250 to the center pole 216 of the center pole assembly 280 takes place in the same fashion as described in the previous embodiment except that the frustoconical portion 265 of the ejection piston 264 forces the center of the top surface 210 of the cap 250 to be stretched downward along the corresponding frustoconical indentation 267 of the center pole 216. The cap 250 and center pole 216 are then ejected by the piston 264 in the same fashion as the previous embodiment. The resulting cap coupling has a better surface contact with the center pole 216 as more surface contact is available for the cap to contact with the center pole. The stretching of the top surface 210 of the cap 250 in combination with the stretching of the cap 250 over the center pole results in a much tighter and secure fit than with previous methods and also results in less chance of air gaps. Although not shown in the previous embodiments, the frustoconical indentation 267 is a standard feature on many of the center pole 216 designs. Accordingly, this embodiment requires only a modification of the original ejection piston 164 and is easily incorporated into the manufacturing environment in such that high volume production can be maintained. The tighter fit also makes the cap 250 more stationary and less susceptible to vibration or coming loose.

Figure 7:
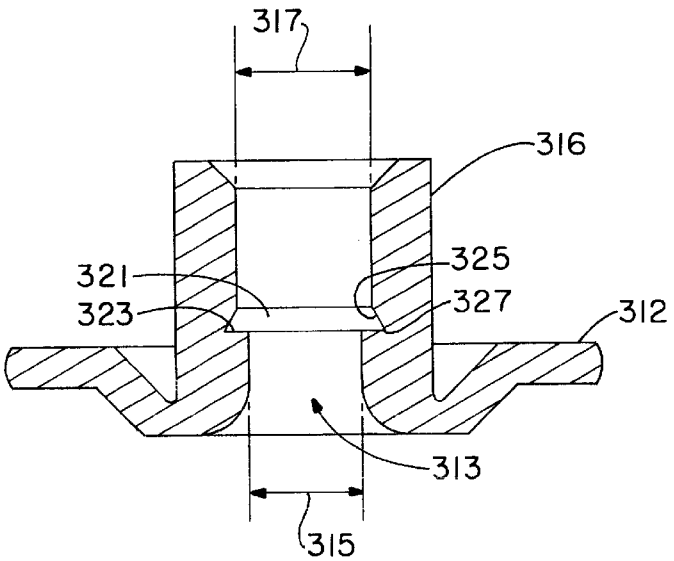
FIG. 7 is an elevational view in cross section of a center pole assembly of the present invention showing the specific features of the through hole.
Figure 7A:
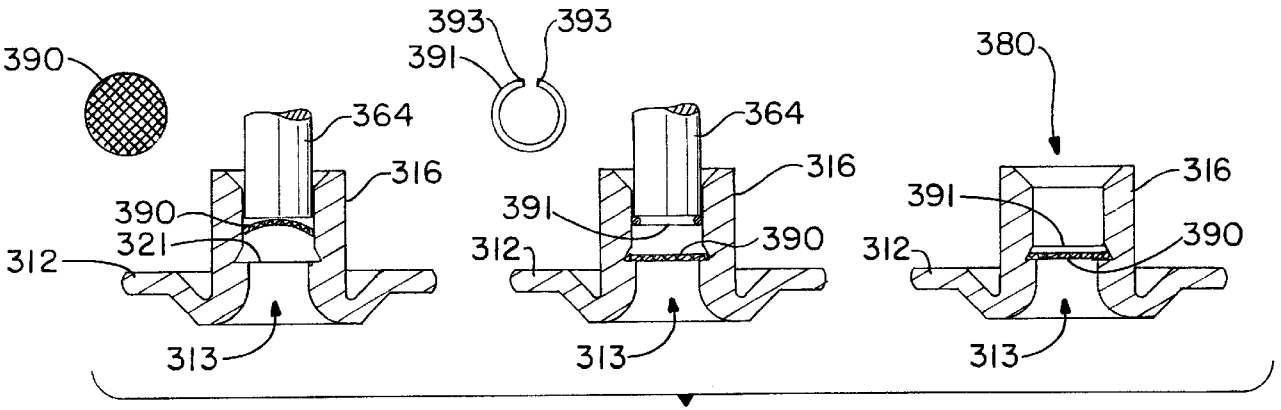
FIG. 7A diagrammatically illustrates the steps for securing a screen within a speaker center pole through hole with the ring retainer.

Although not discussed, larger speakers have center pole assemblies with through holes extending through the longitudinal axis of the center pole. It is important that dust and other contaminants are kept from traveling up this passage where they can affect the diaphragm thus resulting in increased distortion and detrimentally affect the speaker performance. Referring now to FIGS. 7 and 7A, another alternate embodiment of the invention is shown. The cross-sectional view of the center pole 316 of pole yolk 312 shows a through hole 313. Although it may be alternately comprised of a single diameter, the through hole 313 is preferably comprised of a first diameter 315 and a second larger diameter 317 such that a horizontal ledge 323 is formed on which a dust screen 390 can be supported within the through hole 313. The first diameter 315 is herein shown as, but not limited to, an as-cast portion tapering in to the first diameter 315 near the bottom of the center pole 316. The second diameter 317 is herein shown as, but not limited to, a counterbore having a second diameter 317 at the top of the center pole 316 which is slightly larger than that of the first diameter 315. An annular groove 321 is preferably cut into the through hole 313 at the horizontal ledge 323. The purpose of the annular groove 321 is to provide a feature that can house a retaining ring 391 and also to provide a wider horizontal ledge 323 to support the dust screen 390 in the through hole 313. The groove 321 is preferably shaped crossectionally as an acute angle, having a horizontal annular flat surface 323 or ledge of a diameter larger than the second diameter 317 and an angled sidewall 325 tapering upward from the apex 327 formed by the flat surface and the angled sidewall until it intersects with the second diameter of the through hole 313.

As shown in FIG. 7A, a dust screen 390 having a diameter substantially equal to that of the horizontal ledge 323 of the annular groove 321, is inserted down the through hole 313 to the horizontal ledge 323 of the annular groove 321 where it is able to reshape to its original size on the ledge. Although not shown, the dust screen 390 can be forced down the smaller through hole 313 using a press 364. Simple presses of this type are known and one of ordinary skill in the art would be able to seat the dust screen 390 on the horizontal ledge 323 using a press. The dust screen 390 is held in place on the horizontal ledge 323 by a screen retaining ring 391. The retaining ring 391 is preferably an annular ring of a which has a opening between its annular ends 393 which allows it to be compressed to a smaller diameter allowing the ring to be pressed through the through hole 313 to the annular groove 321. The retaining ring 393 in its uncompressed state is preferably of a larger diameter than the annular groove 321 such that the ring will be compressibly retained in a manner preventing rotation or any movement of the ring or of the retained dust screen 390. The insertion of the retaining ring 391 into the through hole 313 is preferably completed using press 364 (also used for seating the dust screen 390) which will force the retaining ring down the hole only until it reaches the annular groove. At that point the angled walls 325 of the annular groove 321 will enable the retaining ring 391 to seat itself into the annular groove. The retaining ring 391 attempts to return to its uncompressed condition when it encounters the acutely angled sidewall 325 of the annular groove 321 which results in a downward movement of the retaining ring until the ring abuts the dust screen 390 on the horizontal ledge 323 of the annular groove. As the retaining ring 391 is still in a compressed state, the retaining ring presses against the acutely angled sidewall 325 of the annular groove 321 which results in a downward force which securely retains the dust screen 390 in position on the horizontal ledge 323. The embodiment is not limited to this particular configuration, as it includes any configuration using a press fit retainer and dust screen.

The dust screen 390 prevents dust and other contamination from entering the through hole 313 of the center pole assembly 380 and thus preventing contamination of the diaphragm which may result in distortion of the speaker. The dust screen is held securely in place by the retaining ring 391 in a manner not affected by temperature or vibration. While the insertion of the dust screen 390 and ring retainer 391 is accomplished in a separate operation independent from the cap coupling operation, it is contemplated that the two could be combined to be accomplished at the same time by a modifying the ejector pistons 164, 264 of the previous embodiments to include a cylindrical extension which would fit into the through hole in a manner forcing the dust screen 390 and retaining ring 391 into the annular groove 321.

While the invention has been particularly shown and described with reference to preferred embodiments thereof, it will be understood by those skilled in the art that various changes in form and details may be made therein without departing from the spirit and scope of the invention.

What is claimed is:

1. A speaker assembly comprising:

a distortion reduction cap; and a cylindrical center pole having a gripping surface formed on an outer cylindrical surface of said center pole and a frustoconical recess on a top surface of said center pole;

sherein said distoration reduction cap is non-rotatablly coupled to said center pole;

wherein a first portion of said cap is deformed against said gripping surface and wherein a second portion of said cap is deformed to form a corresponding frustoconical portion mating with said frustoconical recess on said top surface of said center pole.

2. A speaker assembly as recited in claim 1, wherein said gripping surface is raised and extends outward from the surface of said center pole, said gripping surface comprising a plurality of grooves arranged in a predetermined manner to promote coupling of said distortion reduction cap to said center pole, said cap at least partially conforming with said plurality of grooves to prevent movement of said cap relative to said center pole.

3. A speaker assembly as recited in claim 1, wherein said gripping surface is comprised of a plurality of indentations on said center pole, said distortion reduction cap partially conforming within said indentations.

4. A speaker assembly as recited in claim 1, wherein said distortion reduction cap comprises:

a top planar surface;

a side wall coupled to the periphery of said top planar surface, said side wall extending from the periphery of and perpendicular to said top planar surface to form an open area within said cap for receiving said center pole; and a flare formed adjacent the bottom edge of said side wall opposite of said top planar surface for coupling to said center pole, said flare extending radially outward to provide clearance for positioning said cap over said gripping surface prior to coupling said cap to said center pole.

5. A speaker center pole assembly comprising:

a center pole having a column portion including an aperture through a longitudinal axis thereof;

a distortion reduction cap coupled to said center pole, wherein said column portion of said center pole includes a frustoconical recess on a top surface of said column wherein said distortion reduction cap is formed with a corresponding frustoconical portion mating with said frustoconical recess on said top surface of said column;

an annular groove formed in said aperture;

a dust screen placed in said annular groove; and a retaining ring adapted to secure said dust screen within said annular groove.

6. A speaker assembly comprising:

a distortion reduction cap;

a center column comprising a top surface on one end of said column and an outer column surface;

a gripping surface formed on said outer column surface; and a frustoconical recess on said top surface of said column;

at least a portion of said gripping surface is raised and extends radially outward from the outer surface of said column, said gripping surface comprising a plurality of grooves arranged in a predetermined manner;

said distortion reduction cap is non-rotatably coupled to said column such that a first portion of said cap is deformed against said gripping surface and a second portion of said cap is deformed to form a corresponding frustoconical portion mating with said frustoconical recess on said top surface of said column.

7. The speaker assembly of claim 6, in which said gripping surface is a knurled surface.

8. A speaker assembly comprising:

a distortion reduction cap;

a center column comprising a top surface on one end of said column and an outer column surface;

a gripping surface formed on said outer column surface; and a frustoconical recess on said top surface of said column;

at least a portion of said gripping surface is comprised of a plurality of indentations formed on said outer surface of said column arranged in a predetermined manner about the circumference of said column;

said distortion reduction cap is non-rotatably coupled to said column such that a first portion of said cap is deformed against said gripping surface and a second portion of said cap is deformed to form a corresponding frustoconical portion mating with said frustoconical recess on said top surface of said column.

9. The speaker assembly of claim 8, in which at least one of said plurality of indentations is generally triangular in shape.

10. The speaker assembly of claim 8, in which said plurality of indentations form a knurled surface.

* * * * *